United States Patent [19]

Hunter et al.

[11] Patent Number: 4,907,373

[45] Date of Patent: Mar. 13, 1990

[54] TORIC FINER-POLISHER

[76] Inventors: Billy D. Hunter, Muskogee, Okla.; Joseph Tusinski, 3401 S. 26th St., Muskogee, Okla.

[21] Appl. No.: 111,029

[22] Filed: Oct. 21, 1987

[51] Int. Cl.[4] ..... B24B 7/00

[52] U.S. Cl. ..... 51/58; 51/124 L; 51/284 R

[58] Field of Search ..... 51/57, 58, 55, 67, 124 L, 51/124 R, 121, 284 R

[56] References Cited

U.S. PATENT DOCUMENTS

| | | | |
|---|---|---|---|
| 3,552,899 | 1/1971 | Tagnon . | |
| 3,732,647 | 5/1973 | Stith | 51/124 L |
| 3,782,042 | 1/1974 | Strasbaugh . | |
| 4,135,333 | 1/1979 | Stith | 51/58 |
| 4,143,490 | 3/1979 | Wood | 51/58 |
| 4,320,599 | 3/1982 | Hill | 51/58 |
| 4,419,846 | 12/1983 | Schimitzek | 51/55 |
| 4,510,717 | 4/1985 | Sherwin | 51/58 |
| 4,521,994 | 6/1985 | Tusinski | 51/67 |
| 4,534,137 | 8/1985 | Sarofeen | 51/57 |

*Primary Examiner*—Frederick R. Schmidt
*Assistant Examiner*—Blynn Shideler
*Attorney, Agent, or Firm*—Bradford E. Kile

[57] ABSTRACT

A toric finer-polisher for the fining and/or polishing of a toric lens comprises a lap table for holding a tool, a spindle on which the lap table is mounted, a rocker arm assembly for holding the lens in contact with the tool, and a motor for driving the spindle and lap table so as to cause relative motion between the tool and the lens, thereby finishing the surface of the lens. The spindle is fixed at its lower end to a gimbal, and is contacted at an intermediate point along the spindle by a timing belt connected to the motor, so as to maximize a gimbal radius of the lap table assembly, thus maintaining a parallel relationship between the tool axis and the lens axis during finishing of the lens surface. Other features of the invention include provision of all motions (rotational, orbital and transverse) by a single motor, provision of a two-spindle arrangement in which dual spindles are timed in their oscillatory motions so as to cancel normally encountered reactionary forces, provision of a gear reduction mechanism between the motor and a break-up motion assembly so as to provide break-up motion on a reduced-speed basis, and provision of a pressure-operated lap table for holding the tool on the lap table surface under the influence of air pressure.

19 Claims, 6 Drawing Sheets

TORIC FINER-POLISHER

TECHNICAL FIELD

The present invention generally relates to a toric finer-polisher. More specifically, the invention relates to an apparatus for the fining and/or the polishing of toric lenses (i.e., the toric surfaces of ophthalmic lenses). Such toric lenses are typically used for astigmatic correction.

In the ophthalmic lens finishing field of technology, the terms "fine" and "polish" are words of art relating to the degree of finish achieved with respect to ophthalmic lenses. Since the present invention can be used for both fining and polishing toric lenses, the terms will be used interchangeably.

BACKGROUND ART

In ophthalmic optics, lens blanks are formed from glass or plastic, and a convex or concave surface of the lens is mounted upon a retaining member known as a lens block. The lens and block are then accurately mounted upon a grinding apparatus wherein a toroidal surface of compound prescriptive value is "rough ground" into a concave portion of the lens. In this regard, a first principal meridian of the lens typically has a different dimension with respect to a second principal meridian normal to the first. Following the initial grinding operation, an ophthalmic lens is fined and then polished to a final prescriptive value. Left and right lenses are then mounted upon an edge grinding machine to cut the outer peripheral shape required for compatibility with an eyeglass frame of an ultimate user or wearer.

In its evolution, the toric lens fining and polishing field of technology has followed a path that had its roots in systems ranging from wheel systems to various oscillatory machines, such systems and machines being directed toward the objective of having a toric lens finished to a desired configuration. In most cases, such systems and machines did an adequate job. However, the processing time was lengthy.

In response to the inadequacies of such first-generation systems and machines, a second generation of systems and machines based on the concept of a gimbal-supported tool was introduced. By way of example, such a second-generation toric finer-polisher is disclosed in U.S. Pat. No. 3,732,647—Stith, assigned to Coburn Manufacturing Company, Inc. of Muskogee, Okla. Such second-generation arrangements allowed for faster movement of the fining-polishing mechanism, and therefore processing time was reduced.

The finer-polisher machine of the aforementioned U.S. patent was used to finish cylindrical lenses. In such cylindrical lens finishers, the toric surface of a lapping tool must be held in engagement with the lens surface and moved relative thereto in a path referred to as a "break-up" motion. Such break-up movement prevents ridges, grooves and other aberrations from being formed in the lens surface, such ridges, grooves and aberrations occurring when regular or uniform motion is utilized. In addition to orbital, break-up motion of the lapping tool, the aforementioned U.S. patent discloses movement of the lens in a transverse motion from side to side. In at least one other system, front to rear motion is added to the transverse motion of the lens to be finished.

Although finer-polisher systems of the type described in the aforementioned U.S. patent were widely utilized, room for significant improvement remained. For example, systems such as that disclosed in the aforementioned U.S. patent suffered from relatively low speed of motion between the lapping tool and the lens, and any attempt to increase the relative speed of motion between the lapping tool and lens caused a sacrifice in the lens finishing ability of the system. It was also considered desirable to be able to easily vary the amplitude of the orbital, break-up motion of such a system.

As a result of attempts to overcome the disadvantages of the system disclosed in the aforementioned U.S. patent of Stith, an improved finer-polisher machine was developed, and is disclosed in U.S. Pat. No. 4,320,599—Hill et al, which is also assigned to Coburn Manufacturing Company, Inc. of Muskogee, Okla. In the arrangement disclosed in this patent, first and second assemblies were provided for carrying a lapping tool and a lens, respectively, and for imparting an orbital break-up motion during the fining and polishing operation. The amplitude of orbital movement in this arrangement was variable by application of a cam assembly for adjustment of the degree of orbital break-up motion of the lens mounting and/or lapping tool. However, there was also a disadvantage with this system in that it was not possible to decrease the speed and amplitude of motion of a lens lapping tool for enhanced control, while at the same time maintaining the feet-per-minute of relative motion between a lens and the tool to facilitate rapid fining and polishing. It was also considered desirable to have a system for achieving motion in an X-Y plane which would eliminate any tendency for the creation of a sawtooth aberration in the lens. Elimination of these problems was thought to be desirable because the rate of finishing of an ophthalmic lens could be increased without sacrificing lens finishing quality of the system.

Accordingly, a further finer-polisher apparatus was developed, and is disclosed in U.S. Pat. No. 4,521,994—Tusinski, which is also assigned to Coburn Manufacturing Company, Inc. of Muskogee, Okla. The arrangement of the Tusinski patent provides for a frame and gimbal-mounted assembly for providing an orbital break-up motion to a lens lapping tool, in combination with an X-Y motion assembly connected to the frame and lens for providing a smooth, Lissajous figure movement to the lens. In the X-Y motion assembly, commonly driven first and second cams provide movements in the X and Y directions, respectively.

In general, in break-up motion devices used with cylindrical lens surfaces, the base and cross-curve of the lapping tool must be maintained in parallel relationship with respect to the base and cross-curve of the lens. The finer-polisher machines of the aforementioned patents employed a gimbal assembly suspended between a pair of brackets extending outwardly from the sidewall of the machine, the gimbal assembly being located a relatively short distance, as measured along a connector rod, from the top of the lapping tool. The gimbal prevents any rotation of the aforementioned rod about its own longitudinal axis, and this is important because the cylindrical surface of the lapping tool must be maintained in accurate rotational alignment with the surface of the lens to be ground. Moreover, the gimbal provides an intermediate point along the length of the rod for pivotally supporting the rod such that the combined rotational and orbital motion imposed on the rod and transmitted via the rod to the lapping tool is both accurate and proportional.

The short radius from the gimbal to the top of the tool has, however, posed problems. For example, lens hydroplaning and excessively long strokes of the tool have resulted. As a result of these deficiencies, complex break-up motions have been required, especially in order to cope with some of the idiosyncrasies of the machines. More and more complex break-up motions have tended to reduce some of the problems. However, such complex motions have had the disadvantage of adversely influencing the integrity of the lens surface radii, which in turn has degraded optical integrity. In some cases, rubber supports have been used in order to compensate for this problem by allowing the tool to move or rotate off-axis. However, this has created a serious flaw in axis integrity which, in some cases, has followed an "S" path instead of a straight line as desired.

Another problem with the X-Y motion assembly of the prior art, in particular that assembly disclosed in the aforementioned patent of Tusinski, involves the exposure of a sliding part of the assembly to abrasive materials created by the fining-polishing operation. Specifically, such X-Y assemblies of the prior art created Y-axis motion by mounting the rocker arm carrying the polishing pins on a rod, the rod being disposed inside of a cylinder so that sliding motion of the rod with respect to the cylinder produced the Y-axis motion of the polishing pins. However, as a result of this arrangement, the exterior surface of the sliding rod was exposed to abrasive materials created by the fining-polishing process, and such abrasive materials became lodged between the sliding rod and its encompassing cylinder, causing damage and/or inefficiency in operation to the X-Y motion assembly.

The following additional patents are considered to be of background interest relative to the present invention: U.S. Pat. No. 913,543—Nichols; U.S. Pat. No. 998,101—Laabs; U.S. Pat. No. 1,593,212 Hart; U.S. Pat. No. 2,051,329—Cook; U.S. Pat. No. 2,176,154—Shannon; U.S. Pat. No. 2,208,527—Houchin; U.S. Pat. No. 2,371,303—Liebowitz; U.S. Pat. No. 3,258,879 Edelstein; U.S. Pat. No. 3,330,075—Suddarth et al; U.S. Pat. No. 3,552,899—Tagnon; and French Pat. No. 755,354—Heim et al.

DISCLOSURE OF INVENTION

The present invention relates to a toric finer-polisher, and more specifically an apparatus for fining and polishing toric lenses. It should be understood that the present invention represents an improvement with respect to the problems encountered in the operation of systems and machines employing a short gimbal radius, that is, a short distance between the gimbal assembly and the lapping tool. As will be discussed in more detail below, the problems encountered in such prior art arrangements are overcome by provision of an apparatus in which axis rotation is practically eliminated. That is to say, in the present invention, a parallel relationship is maintained between the axis of the tool and the axis of the lens being fined and polished.

Furthermore, in accordance with the present invention, an X-Y motion assembly is provided wherein Y-motion is created via rotational manipulation of a portion of the X-Y motion assembly. As a result of elimination of any sliding relationship between component parts of the X-Y motion assembly, the previously discussed problem involving exposure of sliding parts of the assembly to abrasive materials created by the fining-polishing process is eliminated.

In addition, in the arrangement of the present invention, all motions (rotational, orbital and transverse) are provided from a single motor. Moreover, a timing belt is employed so that two spindles of the arrangement are timed in their oscillatory motions, and thus movement of the masses of the two spindles cancel reactionary forces so as to minimize vibration and allow the machine to be run at faster speeds.

Finally, the arrangement of the present invention includes a lap table provided with a pressure-operated tool holding capability, as a result of which the tool is easily and securely fixed to the table for the fining-polishing operation.

Therefore, it is a primary object of the present invention to provide a toric finer-polisher.

It is an additional object of the present invention to provide an arrangement or system for the fining and polishing of toric lenses.

It is an additional object of the present invention to provide a system or arrangement which, by its design, represents an improvement with respect to the short-radius arm problem encountered in gimbal-supported arrangements of the prior art.

It is an additional object of the present invention to provide a system or arrangement wherein axial rotation between the axis of the tool and the axis of the lens is practically eliminated.

It is an additional object of the present invention to provide a system or arrangement having an X-Y motion assembly in which all motions, and in particular Y-axis motion, are produced as a result of rotational movement of components of the assembly.

It is an additional object of the present invention to provide a system or arrangement wherein rotational, orbital and transverse motions are provided by a single motor.

It is an additional object of the present invention to provide a system or arrangement wherein dual spindles are timed in their oscillatory motions so that reactionary forces are cancelled, thus minimizing vibration and permitting faster speed of operation of the system or arrangement.

It is an additional object of the present invention to provide a system or arrangement having a pressure-operated tool holding arrangement for securing a lapping tool to a lap table for the fining-polishing operation.

The above and other objects, as will hereinafter appear, and the nature of the invention will be described in more detail below by reference to the detailed description, the figures of the drawings, and the appended claims.

BEST MODE FOR CARRYING OUT THE INVENTION

The toric finer-polisher and its operation will now be described in more detail with reference to the various figures of the drawings.

Figure 1:
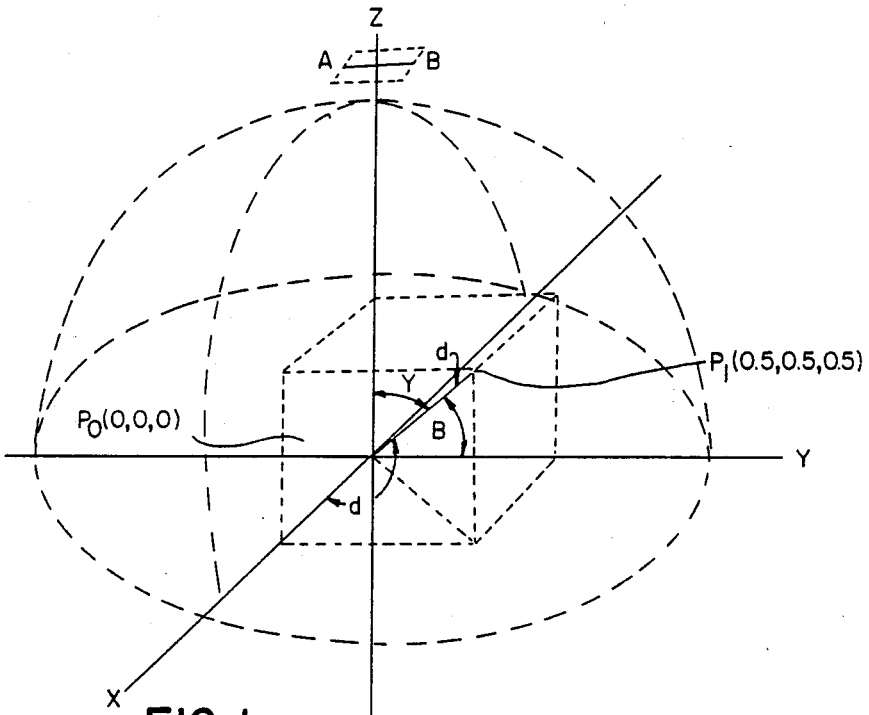
FIG. 1 is a graphical illustration relating to the movement of a tool in a non-oblique manner within a hemispheric envelope.

FIG. 1 is a graphical illustration used to describe the movement of a tool in a non-oblique manner within its hemispheric envelope. In FIG. 1, point $P_0(0,0,0)$ represents the origin of an X-Y-Z axis system and the centric of the hemispheric envelope created by tracing point $P_1$ throughout its convolutions, the point $P_1$ being located a distance d from the origin $P_0$. For illustrative purposes, "d" is defined as having a unity radius, and $P_0$ occupies the position of a gimbal with free axes in the X-Y meridians. Certain mechanical restraints prevent $P_1$ from inscribing the total hemisphere, but this should not detract from an understanding of the principles explained herein.

In FIG. 1, the line A-B represents the cylindrical axis of a tool within a tool plane which is always perpendicular to the radius arm "d" regardless of its position in the hemispheric envelope. It can be intuitively surmised that, if "d" is moved by rotation around the X-axis, the tool axis A-B will remain parallel to the Y-Z plane and perpendicular to the X-Z plane. Similarly, if "d" is rotated about the Y-axis, tool axis A-B remains parallel to the Y-Z plane and perpendicular to the X-Z plane. However, if "d" is moved obliquely to the point $P_1$, it can be shown that the tool axis A-B is no longer parallel to the Y-axis or perpendicular to the X-axis when the tool axis A-B is projected into the X-Y plane.

Figure 2:
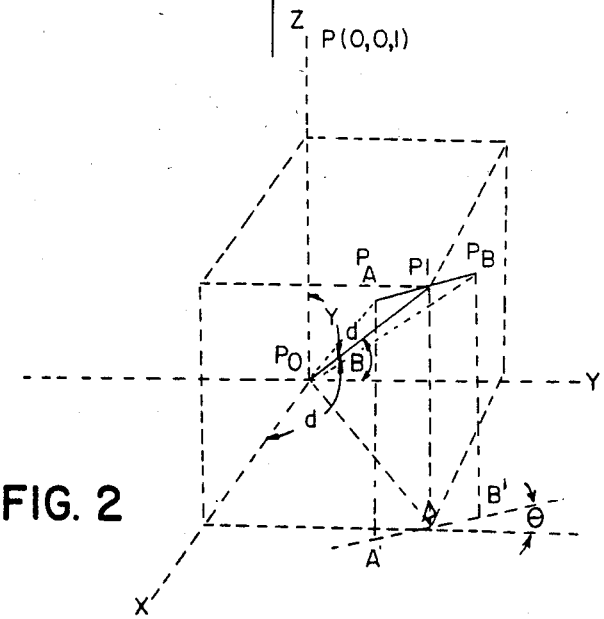
FIG. 2 is a graphical illustration used to explain the problem created by oblique movement of a tool within the hemispheric envelope.

FIG. 2 is a graphical illustration used to demonstrate the latter point. In FIG. 2, the radius arm (corresponding to the shaft of a tool) "d" has been moved to an oblique position having an angular displacement of 45° with respect to the X, Y and Z axes. In such a position, the tool axis (A-B in FIG. 1) occupies a position corresponding to points $P_A$, $P_1$ and $P_B$ (in FIG. 2). Presuming that the coordinates of point $P_1$ are (0.5, 0.5, 0.5), when the tool axis is projected into the X-Y plane, the projected line A'-B' is no longer parallel to the Y-axis, there being an angle $\theta$ between the line A'-B' and the Y-axis. In this regard, it is necessary to iterate that the tool shaft "d" is constrained by gimbal bearings from rotating around the X and Y axes. This restraint is imposed on the tool shaft "d" by the mechanism driving the tool shaft "d" and by the fact that the distal tool shaft is restrained by the physical size of the gimbal associated with it.

Earlier assumptions, during the development of the technology disclosed in the aforementioned patent of Stith, were that the tool axis A-B would remain parallel to the X and Y axes when rotated to an oblique position. Referring to FIG. 2, it should be noted that, if the point $P_1$ oscillates about the Z-axis (as might be required in toric lens fining-polishing), the oscillatory path of the point $P_1$ would have some fixed distance appropriate for a toric lens diameter. However, if the length of the shaft "d" is relatively short (as is the case in those prior art arrangements having a short gimbal radius), the angle $\theta$ shown in FIG. 2 will be significant, that is to say, there will be a significant non-parallel relationship between the projected tool axis A'-B' and the Y-axis.

Figure 5:
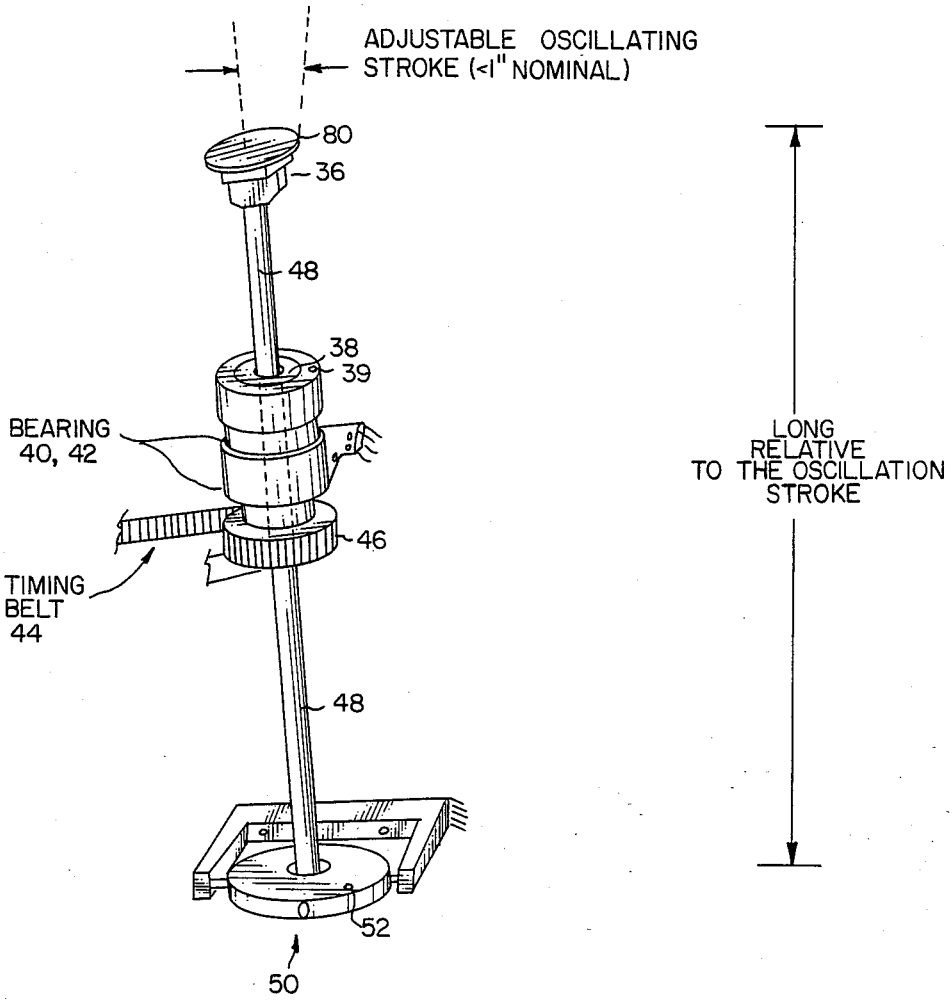
FIG. 5 is a perspective view of the lap table and its component moving parts within the toric finer-polisher of the present invention.

In accordance with the present invention, it has been discovered that, conversely, if the shaft "d" is kept relatively long, then the angle $\theta$ shown in FIG. 2 will be insignificant when the position of $P_1$ is small with respect to the X-axis note FIG. 5. That is to say, there will be an insignificant non-parallel relationship between the projected axis A'-B' and the Y-axis, the projected axis being virtually parallel to the Y-axis. This is a basic feature of the design of the present invention, and it is this feature which leads to a reduction in the number of break-up motions required for a high degree of integrity in the toric fining-polishing procedure. Furthermore, in accordance with the present invention, a majority of the break-up motion is relegated to the upper arm (or rocker arm assembly used to constrain the blocked lens on axis) of the toric finer-polisher.

Figure 3:
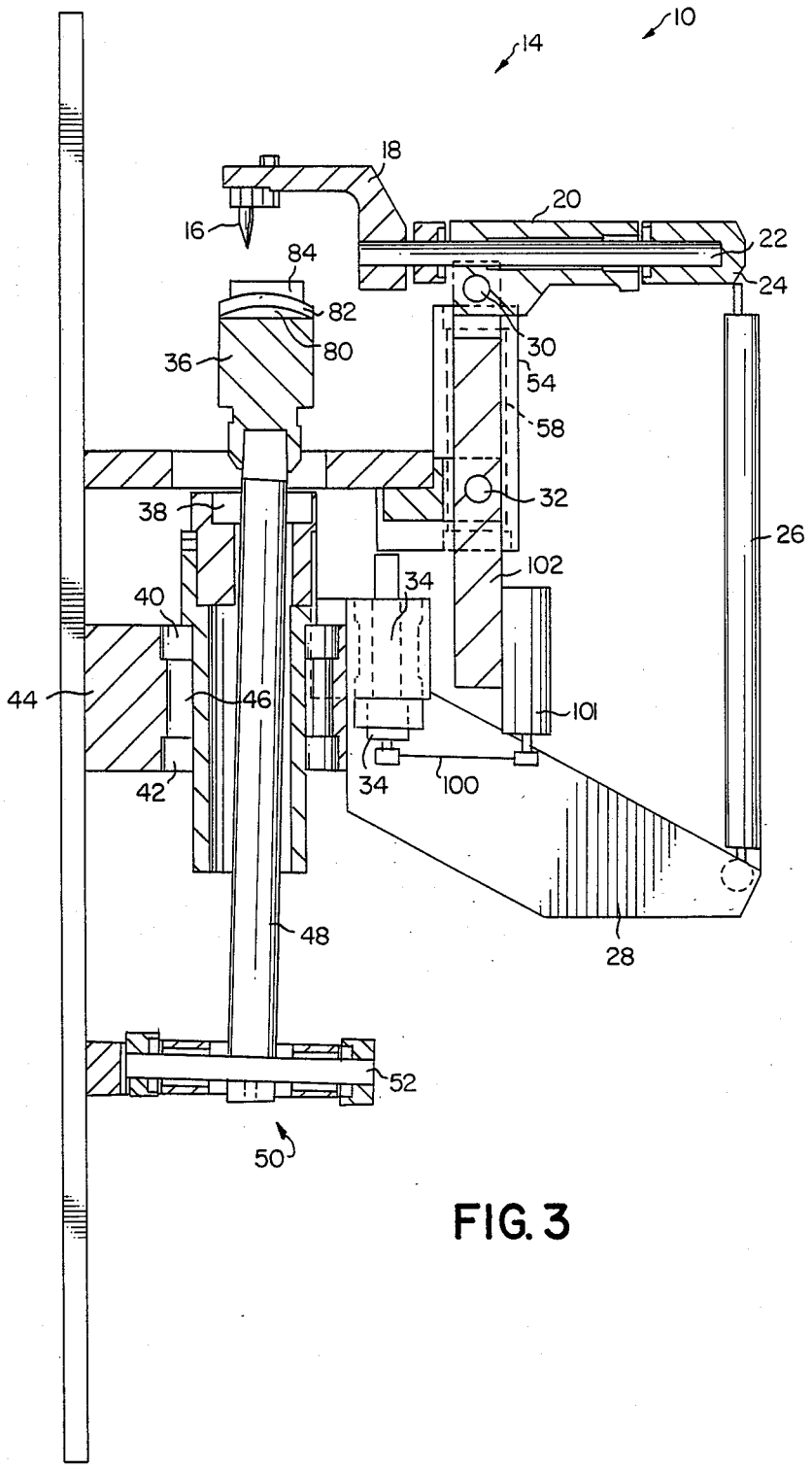
FIG. 3 is a side view, partially in section, of the toric finer-polisher arrangement of the present invention.
Figure 4:
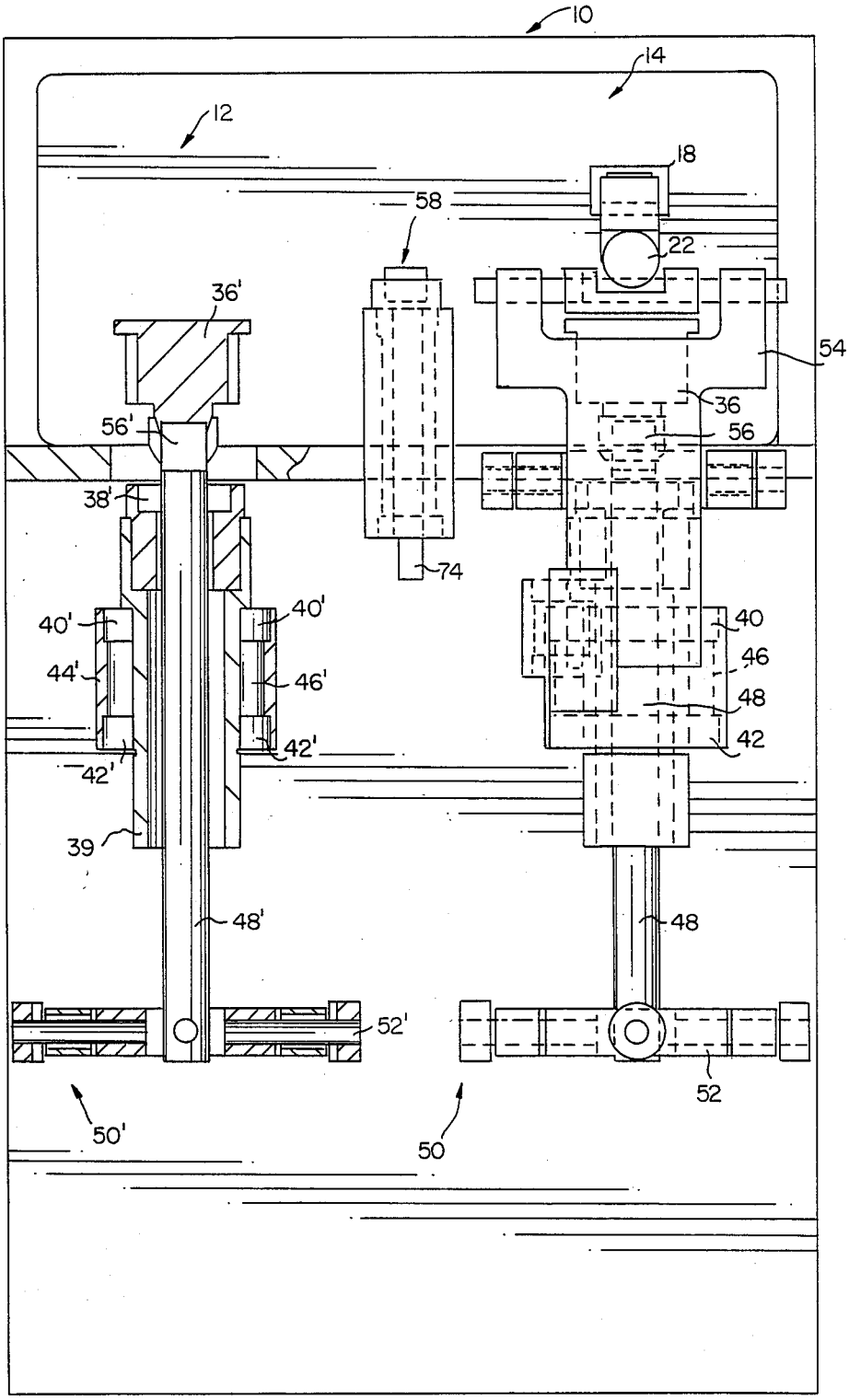
FIG. 4 is a front view, partially in section, of the toric finer-polisher of the present invention.

FIG. 3 is a side view and FIG. 4 is a front view, both in partial section, of the toric finer-polisher of the present invention, while FIG. 5 is a perspective view of the lap table and its moving components within the toric finer-polisher of the present invention. In these figures, identical reference numerals have been used to identify identical parts as appropriate.

Referring to FIGS. 3 and 4, the toric finer-polisher 10 is understood to include a lefthand section 12 and a righthand section 14, the lefthand section 12 being only partially shown in FIG. 4. The righthand portion 14 appears in both the side view of FIG. 3 and the front view of FIG. 4. Since the lefthand and righthand arrangements 12 and 14, respectively, are identical in every respect, only the righthand arrangement 14 will be described with reference to FIGS. 3 and 4.

Referring to FIGS. 3 and 4, the righthand arrangement 14 of the toric finer-polisher 10 includes the following elements: polishing pins 16, rocker arm 18, rocker arm housing 20, rocker arm shaft 22, rocker arm holder 24, air cylinder 26, bracket 28, pins 30 and 32, rotary eccentric 34, lap table 36, spherical bearing 38, bearing holder 39, upper bearing 40, lower bearing 42, timing belt 44, timing belt pulley 46, shaft or spindle 48, E-mounting plate 50, and axis plate 52.

Figure 6:
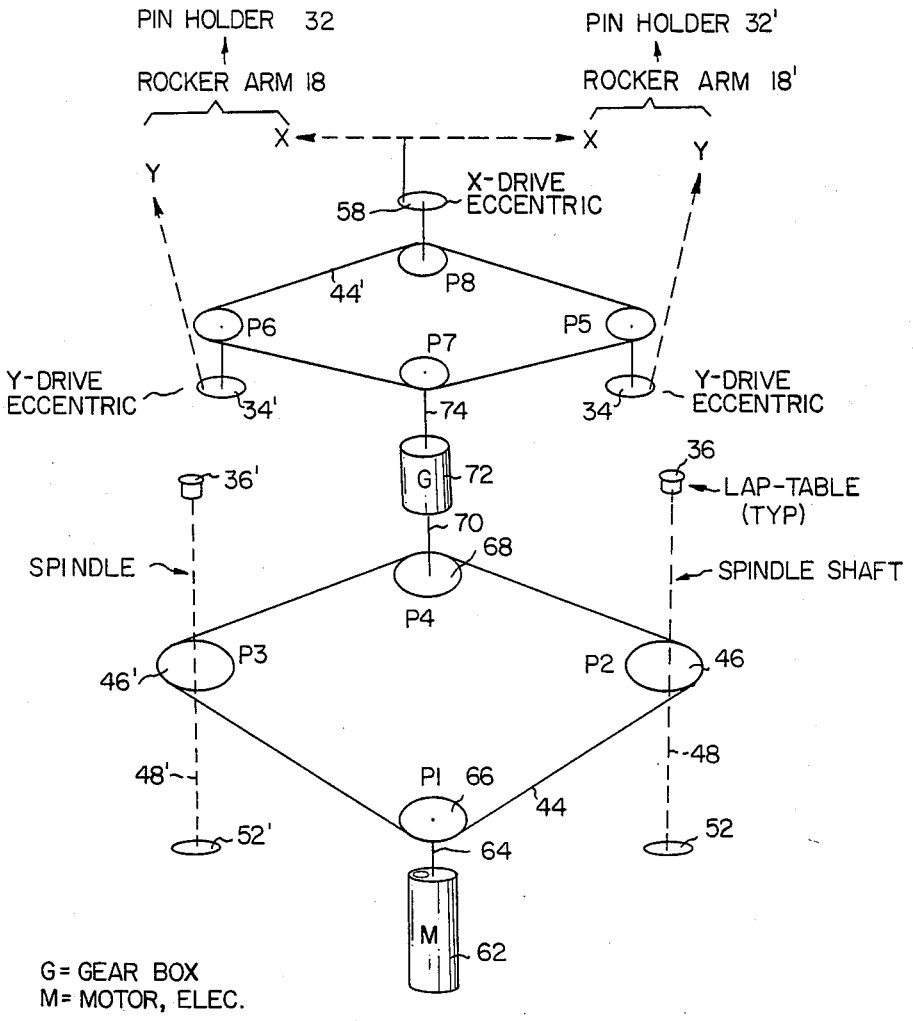
FIG. 6 is a diagrammatic representation of the single-motor drive system of the toric finer-polisher of the present invention.

FIG. 6 is a diagrammatic representation of the single-motor drive system of the toric finer-polisher of the present invention. As seen therein, the single-motor drive system comprises a motor 62, motor shaft 64, motor pulley 66, timing belt pulleys 46 and 46' associated with the shafts 48 and 48', respectively, gear reduction pulley 68, gear reduction shaft 70, gear reduction mechanism 72, eccentric shaft 74, timing belt 44 which interconnects and drives pulleys 46, 46', 66 and 68, X-drive eccentric 58, Y-drive eccentrics 34 and 34' and timing belt 44' which interconnects and drives eccentric pulleys P5-P8.

Thus, all motions in the toric finer-polisher are driven from the single motor 62. The spindles or shafts 48 and 48' driven by the pulleys 46 and 46' are timed in their oscillatory motions so that movements of their masses cancel reactionary forces in order to minimize vibration and allow the toric finer-polisher to be run at faster speeds. Furthermore, the speed of operation of motor 62 is reduced by gear reduction mechanism 72 prior to being applied to the X-drive eccentric 5 and Y-drive eccentrics 34 and 34', so that upper arm motions (that is, X-Y motions of the rocker arm 18) are carried out on a reduced-speed basis. The difference in horizontal (X) and vertical (Y) drive speeds is obtained by changing drive ratios (that is, the number of teeth) of the respective timed pulleys P8, P5 and P6.

In operation, motor 62 drives pulleys 46 and 46' via timing belt 44. Pulleys 46 and 46', in turn, rotate shafts 48 and 48' carrying lap tables 36 and 36'.

As shown in FIG. 3, lap table 36 acts as a tool holder for holding a lapping tool 80, on top of which a lens to be fined-polished is mounted, a block 84 being mounted on top of the lens 82. When a fining-polishing operation is to be carried out, pins 16 are lowered into contact with the upper surface of block 84 by actuation of air cylinder 26. Specifically, air cylinder 26 is operated to raise the rocker arm holder 24, thus lowering the pins 16 so that the pins 16 are positioned in depressions (not shown) in the upper surface of block 84. As previously indicated, oscillation or orbiting of the shafts 48 and 48' by motor 62, operating via timing belt 44 and pulleys 46 and 46', results in orbital motion of the lens 82 with respect to the tool 80. Shafts 48 and 48' are constrained against rotation by plates 52 and 52', respectively (FIG. 4).

With respect to X-Y motion, X-drive eccentric 58 controls X-motion while Y-drive eccentrics 34 and 34' control Y-motion. It should be noted that X-drive eccentric 58 is common to both the left and the right units, while each unit has its own Y-drive eccentric 34 and 34', respectively. X-motion is carried out in a manner as disclosed in the aforementioned patent of Tusinski. Eccentric 58 is mounted between the lefthand arrangement 12 and righthand arrangement 14 of the toric finer-polisher 10, eccentric 58 being driven at a reduced speed by the motor 62, operating via motor shaft 64, motor pulley 66, timing belt 44, gear reduction pulley 68, gear reduction shaft 70, gear reduction mechanism 72, output shaft 74, timing belt 44' and pulley P8. As a result of being driven at a reduced speed, eccentric 58 operates in manner described in the aforementioned Tusinski patent to move rocker arm 18 (and its counterpart, not shown, in the lefthand arrangement 12) to the left and right as viewed in FIG. 4. Thus, X-motion is achieved.

(Y-motion is achieved in the present invention in a manner which represents an improvement over the Y-motion assembly disclosed in the aforementioned Tusinski patent.) Referring to FIG. 3, Y-drive eccentrics 34 and 34' are driven by motor 62 operating via motor shaft 64, timing belt 44, pulley 68, shaft 70, gear reduction mechanism 72, shaft 74, pulley P7 and Y-drive pulleys P5 and P6, respectively.

As a result of the operation of Y-drive eccentrics 34 and 34', forces are applied to rocker arms 18 and 18', and their associated housings 20 and shafts 22, causing polishing pins 16 to rotate or pivot about pin holders 32 and 32' (FIGS. 3 and 6). In this manner, pins 16 cause the lens 82 as carried by the block 84 to move to the left and right as seen in FIG. 3, thus achieved Y-motion. It should be noted that the latter operation is facilitated by the provision of a linkage 100 connecting a pivot arm 101 to the Y-drive eccentric 34.

The X-Y or break-up motion achieved in accordance with the foregoing is, preferably, a Lissajous pattern similar to that disclosed and discussed in the aforementioned Tusinski patent. However, the motions imparted to the lens 82 (FIG. 3) are imparted in a relatively simple manner. In order for the Lissajous pattern to continuously change, horizontal and vertical drive speeds cannot be ratioed by an integer value. In addition, to reduce the complexity of the pattern, a ratio of approximately 1.99 to 1.00 permits the pattern to vary from a figure "8" to a "U" pattern or to a "  " pattern.

Figure 7:
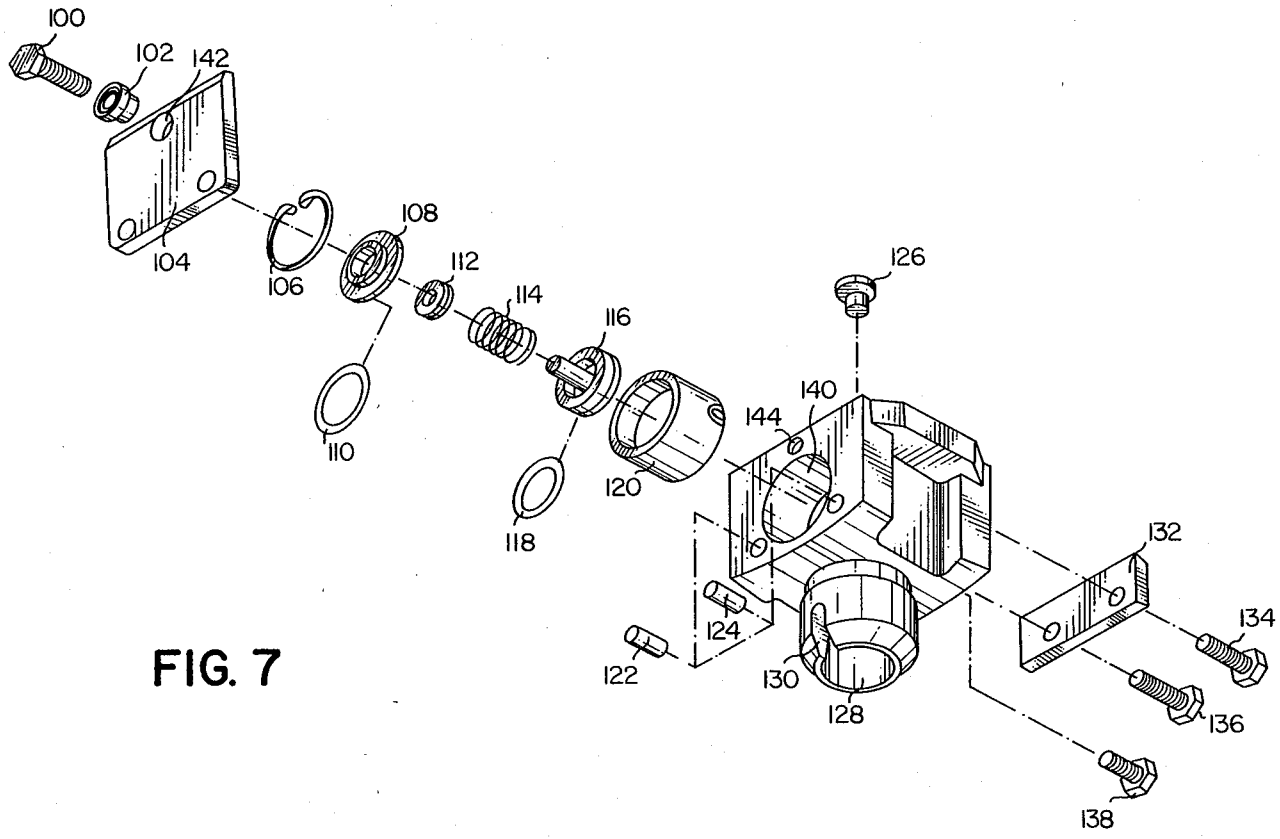
FIG. 7 is a perspective view of the pressure-operated holding arrangement within the lap table of the present invention.

FIG. 7 is a perspective view of the component parts of the pressure-operated tool holding arrangement within the lap table of the present invention. As seen therein, the lap table 36, 36' comprises the following elements: bolt 100, spacer 102, front jaw 104, retainer ring 106, cylinder end cap 108, O-ring 110, seal 112, compression spring 114, piston 116, O-ring 118, cylinder 120, pins 122 and 124, plug 126, internal taper 128, axis alignment slot 130, rear clamp plate 132, and bolts 134, 136 and 138.

As indicated in previously discussed FIGS. 3 and 4, the lap table 36, 36' is mounted on the upper end of shafts 48, 48' via the internal taper 128. Axis alignment slot 130 is provided for the insertion of a pin (not shown) into a corresponding hole in the shafts 48, 48', thus achieving alignment of the shafts 48, 48' relative to the lap tables 36, 36'.

Rear clamp plate 132 is fixed to one side of the lap table 36, 36' by bolts 134 and 136. Bolt 138 merely covers an access hole (not shown) which is used to push the cylinder 120 (and its associated assembly) out of the orifice 140 for possible service or repair.

Retainer ring 106, end cap 108, O-ring 110, seal 112, spring 114, piston 116, O-ring 118, and cylinder 120 are assembled in the manner indicated in FIG. 7, and this assembly is inserted into the orifice 140 in the side of lap table 36, 36'. Front jaw 104 is positioned against the same side of lap table 36, 36' by means of the positioning pins 122 and 124, and front jaw 104 is fixed to the lap table 36, 36' by insertion of spacer 102 into the top hole 142 of front jaw 104 and by the insertion of bolt 100 via spacer 102 into the hole 144 in the side of lap table 36, 36'.

As thus assembled, a given amount of spacing is maintained between rear clamp plate 132 and front jaw 104. When a tool is to be mounted on the top surface of lap table 36, 36', the tool is placed into the space between the rear clamp plate 132 and front jaw 104. Air pressure is then applied to the interior of lap table 36, 36', forcing piston 116 contained within cylinder 120 to push against front jaw 104 at a point below the spacer 102 and bolt 100, and this causes a rotational movement of the top edge of front jaw 104 toward the rear clamp plate 132, thus securing the tool on the top surface of lap table 36, 36'. When release of the tool is desired, the air pressure to the interior of the lap table 36, 36' is reduced, the piston 116 withdraws, and the top edge of front jaw 104 moves away from rear clamp plate 132, thus releasing the tool from the top surface of lap table 36, 36'.

The lap table 36, 36' is provided with a plug 126 which fits into a screwhole (not shown) in the upper surface of lap table 36, 36'. The plug 126 prevents air from escaping from the interior of lap table 36, 36' during operation thereof. In addition, the plug 126 serves to keep foreign material from entering the interior of the lap table 36, 36'. When removal of the lap table 36, 36' from the shaft 48, 48' is desired, the plug 126 can be removed, and a screw can be inserted into the screwhole (not shown) so as to impinge upon and force downward the shaft 48, 48', thus removing the lap table 36, 36' therefrom.

ADVANTAGES OF THE INVENTION

After reviewing the foregoing description of a preferred embodiment of the invention, in conjunction with the drawings, it will be appreciated by those of skill in the art that several distinct advantages of the finer-polisher are obtained.

Without attempting to set forth all of the desirable features of the present invention, it is to be understood that a major advantage of the present invention resides in the fact that, in the present invention, the spindle or shaft is fixed at its lower end, while driving motion is applied at an intermediate point, thus increasing substantially the radius arm, that is, the distance between the fixed point of the spindle or shaft and the working end at which the tool is mounted. As mentioned earlier, this increased radius arm results in the ability of the present invention to maintain the tool axis parallel to the Y-axis even during oblique positioning of the tool relative to the X-Y-Z coordinate system. In this manner, a significant

What is claimed:

1. An apparatus for finishing a toric surface of an ophthalmic lens, comprising:

tool carrying means for carrying a lens finishing tool having a compound curvature and a major tool cylindrical axis, said tool carrying means having a first end at which said tool is disposed and a second end;

lens holding means for holding said ophthalmic lens in contact with said lens finishing tool, said lens having a major lens cylindrical axis;

motor means connected to said lens holding means for driving said tool carrying means in a substantially uniform circular orbital motion to cause said tool to move relative to said toric lens and thereby promote finishing of said surface of said lens;

said motor means being connected to said lens holding means at a location intermediate to said first end and said second end of said tool carrying means; and gimbal means engaging said tool carrying means at said second end for supporting said tool carrying means at said second end, so as to maximize a gimbal radius of said tool carrying means and enable the substantially uniform circular orbital motion of said finishing tool to have an oscillating excursion stroke less than one inch while maintaining a substantially parallel relationship between the major tool cylindrical axis and the major lens cylindrical axis during finishing of said surface of said lens.

2. The apparatus of claim 1, wherein said motor means comprises a timing belt and a motor, said motor driving said timing belt, said timing belt contacting said tool carrying means at said intermediate point so as to move said tool relative to said lens.

3. The apparatus of claim 2, wherein said tool carrying means comprises a spindle and a timing belt pulley connected thereto for mutual rotation therewith, said timing belt being engaged with said timing belt pulley for rotation of said timing belt pulley and consequent rotation of said spindle.

4. The apparatus of claim 1, further comprising additional tool carrying means for carrying an additional tool, and additional lens holding means for holding an additional lens having a surface to be finished in contact with said additional tool, said motor means driving said additional tool carrying means so as to cause said additional tool to move relative to said additional lens, thereby finishing said surface of said additional lens.

5. The apparatus of claim 4, wherein said motor means drives said tool carrying means and said additional tool carrying means so as to cause said tool and said additional tool to move in oscillatory motions relative to said lens and said additional lens, respectively, and wherein said motor means times said tool and said additional tool in their oscillatory motions so that movements of their masses cancel reactionary forces, thereby minimizing vibration and allowing the apparatus to be operated at relatively faster speeds.

6. The apparatus of claim 1, wherein said lens holding means comprises a rocker arm assembly having bearing means isolated from an abrading zone surrounding a lens to be polished and a lens finishing tool and being operable to permit travel of a lens in orthogonal X and Y directions of travel.

7. The apparatus of claim 6, wherein said lens holding means further comprises an air cylinder connected to said rocker arm assembly, said air cylinder being pressure-operated to compel said rocker arm assembly to hold said lens in contact with said tool.

8. The apparatus of claim 1, further comprising break-up motion means connected to said lens holding means for manipulating said lens holding means so as to apply break-up motion to said lens during the finishing of said surface of said lens.

9. The apparatus of claim 8, wherein said break-up motion means manipulates said lens holding means so as to apply to said lens, during the finishing of said surface of said lens, break-up motions in a first direction and in a second direction generally orthogonal to said first direction.

10. The apparatus of claim 9, wherein said break-up motion means comprises an X-drive eccentric for providing the break-up motion in said first direction.

11. The apparatus of claim 9, wherein said break-up motion means comprises a Y-drive eccentric for providing the break-up motion in said second direction.

12. The apparatus of claim 9, further comprising additional tool carrying means for carrying an additional tool, and additional lens holding means for holding an additional lens having a surface to be finished in contact with said additional tool, said break-up motion means comprising a first Y-drive eccentric for applying the break-up motion in said second direction to said lens and a second Y-drive eccentric for applying the break-up motion in said second direction to said additional lens.

13. The apparatus of claim 8, further comprising gear reduction means interposed between said motor means and said break-up motion means for applying driving force from said motor means to said break-up motion means on a reduced-speed basis, whereby the break-up motions are applied to said lens on a reduced-speed basis.

14. An apparatus for finishing a surface of a lens, comprising:

tool carrying means for carrying a tool having a tool axis, said tool carrying means having a first end at which said tool is disposed and a second end;

lens holding means for holding said lens in contact with said tool, said lens having a lens axis; and motor means for driving said tool carrying means so as to cause said tool to move relative to said lens, thereby finishing said surface of said lens;

wherein said motor means contacts said tool carrying means at an intermediate point between said first end and said second end; and wherein said apparatus further comprises gimbal means engaging said tool carrying means at said second end for supporting said tool carrying means at said second end, so as to maximize a gimbal radius of said tool carrying means, whereby to maintain a parallel relationship between the tool axis and the lens axis during finishing of said surface of said lens; and wherein said tool carrying means comprises a lap table having a hollow interior and having a top surface on which a tool to be finished is disposed, said tool carrying means further comprising a rear jaw fixed to a vertical side of said lap table and having an upper portion extending above the top of the lap table, a movable front jaw fixed to an opposite vertical side of said lap table and having an upper portion extending above the top surface of said lap table, and a piston contained within the interior of said lap table and movable therein, wherein said movable front jaw has a normally relaxed position such that a maximum distance between the upper portion of said front jaw and the upper portion of said rear jaw is maintained, and wherein said piston is responsive to pressure applied to the interior of said lap table for moving so as to bear against a lower portion of said front jaw causing a movement of the upper portion of said front jaw toward the upper portion of said rear jaw, whereby a tool positioned on the top surface of said lap table between said front jaw and said rear jaw is clamped and held in place.

15. An apparatus for finishing a surface of a lens, comprising:

tool carrying means for carrying a lens finishing tool having a compound curvature and a major tool cylindrical axis;

lens holding means for holding a lens in contact with the lens finishing tool, the lens having a major lens cylindrical axis;

motor means connected to said tool carrying means for driving said tool carrying means so as to cause a tool mounted upon said tool carrying means to move relative to a lens held by said lens holding means, thereby finishing the surface of a lens;

break-up motion means connected to said lens holding means for manipulating said lens holding means so as to apply break-up motion to a lens held by said lens holding means while the surface of the lens is being finished;

gear reduction means connecting said motor means to said break-up motion means for providing driving force from said motor means to said break-up motion means on a reduced-speed basis, whereby said break-up motion is applied to said lens holding means on a reduced-speed basis; and gimbal means engaging said tool carrying means for supporting said tool carrying means with a gimbal radius between said gimbal means and a tool carried by said tool carrying means which is long relative to a maximum of one inch oscillating excursion stoke of a tool connected to said tool carrying means to enable a finishing tool to maintain a substantially parallel relationship between the major tool cylindrical axis and the major lens cylindrical axis during finishing of the surface of a lens particularly at oblique excursions of the tool carrying means.

16. The apparatus of claim 1, wherein said break-up motion means manipulates said lens holding means so as to apply to said lens, during the finishing of said surface of said lens, break-up motions in a first direction and in a second direction generally orthogonal to said first direction.

17. The apparatus of claim 16, wherein said break-up motion means comprises an X-drive eccentric for providing the break-up motion in said first direction.

18. The apparatus of claim 16, wherein said break-up motion means comprises a Y-drive eccentric for providing the break-up motion in said second direction.

19. The apparatus of claim 16, further comprising additional tool carrying means for carrying an additional tool, and additional lens holding means for holding an additional lens having a surface to be finished in contact with said additional tool, said break-up motion means comprising a first Y-drive eccentric for applying the break-up motion in said second direction to said lens and a second Y-drive eccentric for applying the break-up motion in said second direction to said additional lens.

* * * * *